US008399769B2

(12) United States Patent
Doll

(10) Patent No.: US 8,399,769 B2
(45) Date of Patent: Mar. 19, 2013

(54) CABLE MANAGEMENT SYSTEM AND METHOD OF USE

(76) Inventor: Jay Thomas Doll, West Des Moines, IA (US)

( * ) Notice: Subject to any disclaimer, the term of this patent is extended or adjusted under 35 U.S.C. 154(b) by 178 days.

(21) Appl. No.: 13/072,661

(22) Filed: Mar. 25, 2011

(65) Prior Publication Data

US 2012/0241195 A1 Sep. 27, 2012

(51) Int. Cl.
*H01B 7/06* (2006.01)

(52) U.S. Cl. ..... 174/135; 174/110 R; 174/138 G; 439/501

(58) Field of Classification Search ..... 174/135, 174/110 R, 138 G; 439/501; 24/306
See application file for complete search history.

(56) References Cited

U.S. PATENT DOCUMENTS

| | | | | |
|---|---|---|---|---|
| 2,533,341 | A | 12/1950 | Alfano | |
| 3,565,738 | A | 2/1971 | Kirkpatrick | |
| 3,626,495 | A | 12/1971 | Bastian, Jr. | |
| 3,735,448 | A | 5/1973 | Waddington | |
| 4,214,349 | A | 7/1980 | Munch | |
| 4,802,638 | A | 2/1989 | Burger et al. | |
| 4,991,265 | A | 2/1991 | Campbell et al. | |
| 5,168,128 | A | 12/1992 | Thomsen | |
| 5,515,580 | A | 5/1996 | McHenry, Jr. | |
| 5,577,932 | A * | 11/1996 | Palmer | 439/501 |
| 5,732,445 | A | 3/1998 | Stodolka et al. | |
| 5,892,177 | A | 4/1999 | Mazaris | |
| 6,142,405 | A | 11/2000 | Black | |
| 6,237,885 | B1 | 5/2001 | Mitchell | |
| 6,802,471 | B1 | 10/2004 | Gambrell | |
| 7,238,889 | B2 * | 7/2007 | Rivera | 174/135 |
| 7,514,631 | B2 | 4/2009 | Martin et al. | |
| 7,610,661 | B2 | 11/2009 | Sween et al. | |
| 7,895,716 | B2 * | 3/2011 | Taillon et al. | 24/16 R |
| 2007/0006426 | A1 | 1/2007 | Fukuyasu et al. | |
| 2007/0034400 | A1 | 2/2007 | Rivera | |
| 2009/0090550 | A1 | 4/2009 | Bird | |
| 2009/0314515 | A1 | 12/2009 | Bevirt et al. | |

* cited by examiner

*Primary Examiner* — Dhirubhai R Patel
(74) *Attorney, Agent, or Firm* — Mathew L. Grell; Balser & Grell IP Law

(57) ABSTRACT

A cable management system and method of use integrated with the cable in general, a coiled cable; a bendable elongated member positioned on one section of the cable; a cover material to affix the elongated member to the cable; wherein the bendable elongated member integrated with the one section of the cable is configured to wrap around the coiled cable and, thus, functions to maintain the coiled cable in an organized manner ready for a subsequent use with minimum risk of cord entanglement.

27 Claims, 5 Drawing Sheets

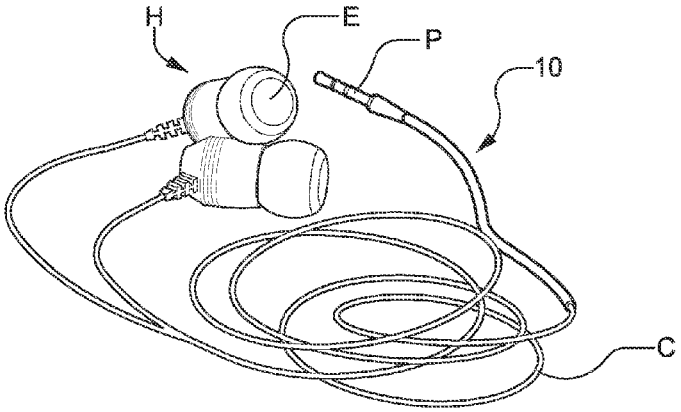
FIG 1.1
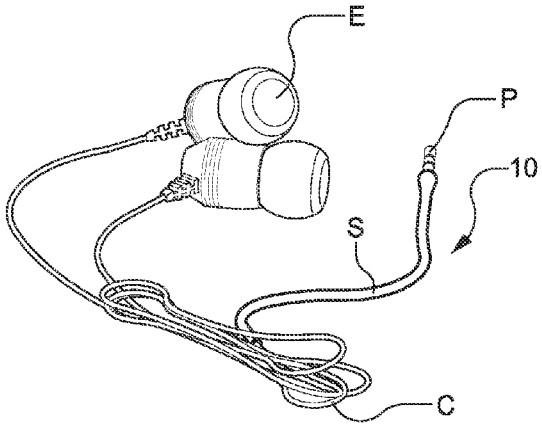
FIG 1.2
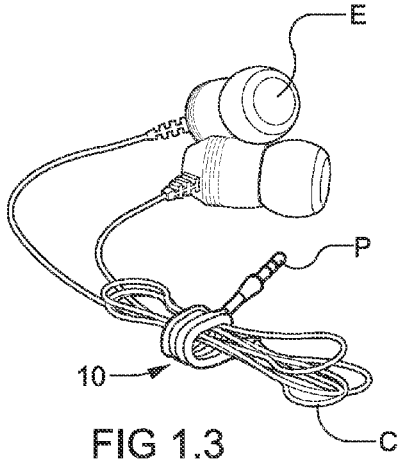
FIG 1.3

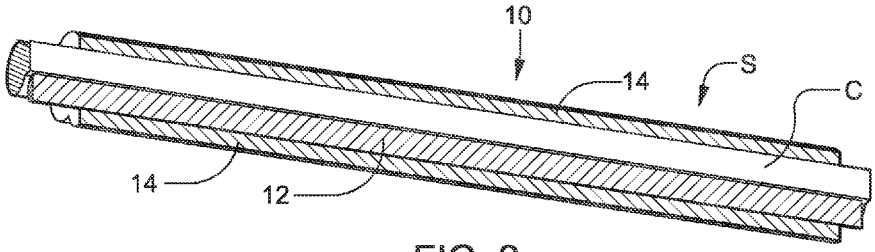
FIG. 2
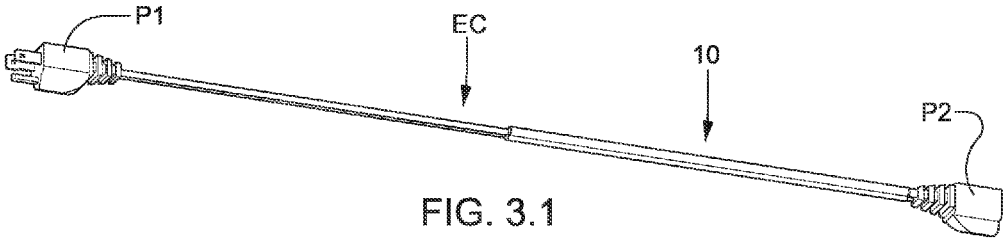
FIG. 3.1
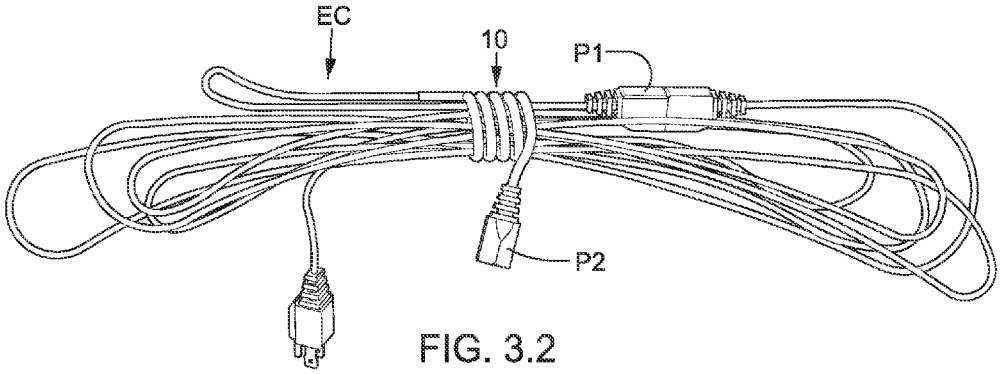
FIG. 3.2
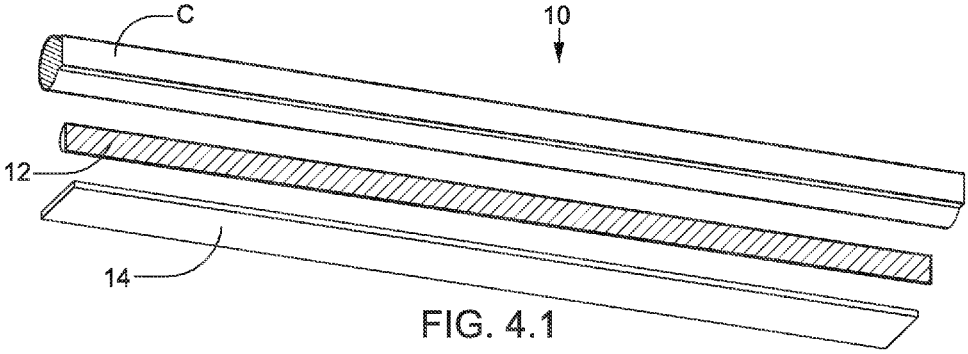
FIG. 4.1

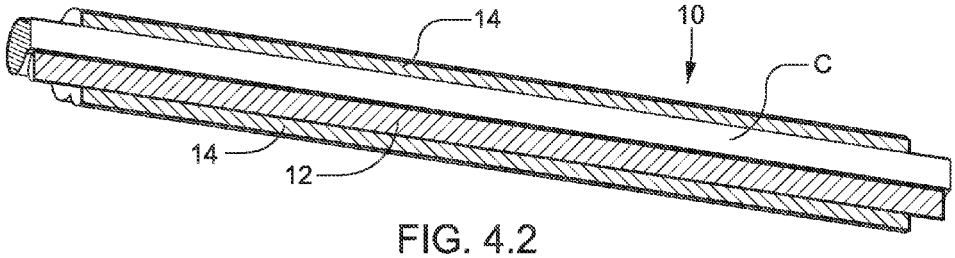
FIG. 4.2
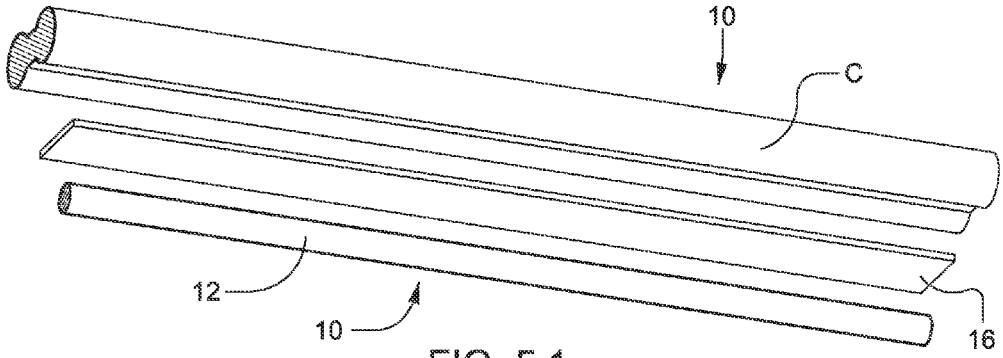
FIG. 5.1
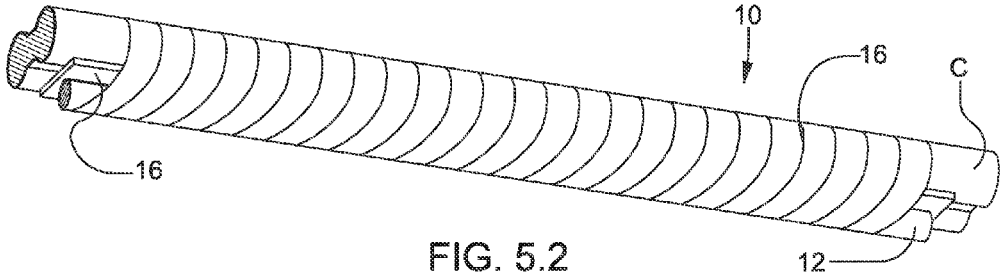
FIG. 5.2
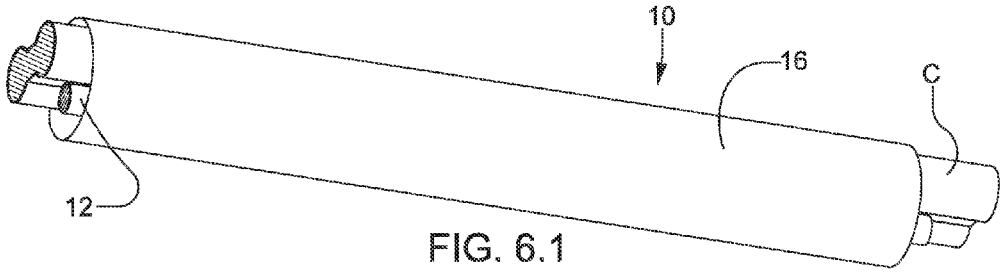
FIG. 6.1

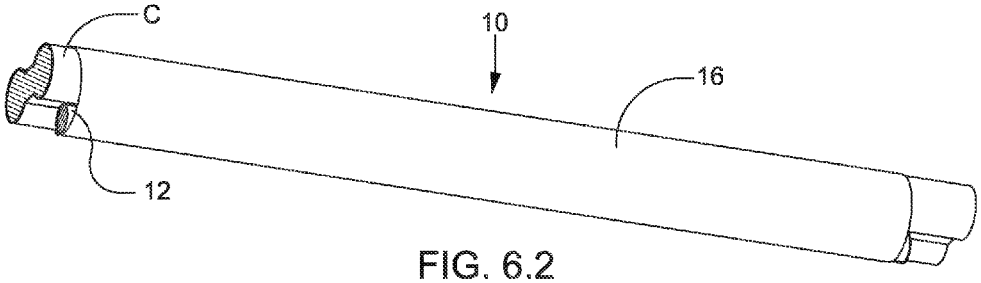
FIG. 6.2
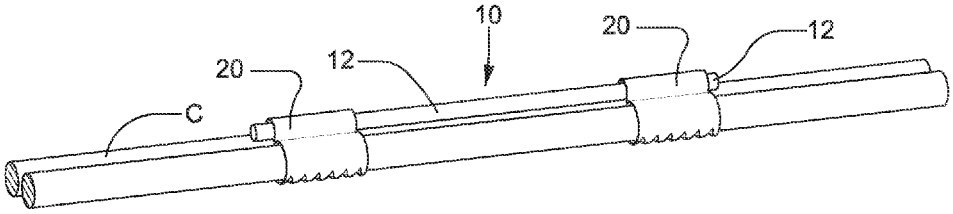
FIG. 7.1
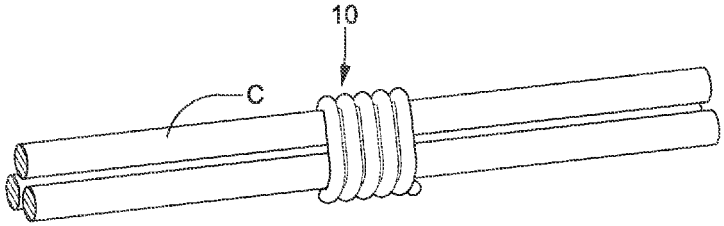
FIG. 7.2
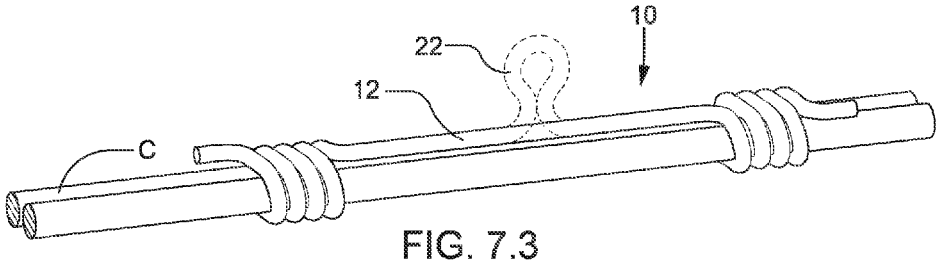
FIG. 7.3

CABLE MANAGEMENT SYSTEM AND METHOD OF USE

TECHNICAL FIELD

The disclosure relates generally to a cable management system and more specifically it relates to wrapping and tying an electrical power cord or the like for electronic devices, appliances, power tools, power cables or other similar cables and employed for quick and easy storing of coiled power cords of different sizes.

BACKGROUND

The increasing popularity and availability of portable electronic devices has resulted in an increasing demand for cable and cord management solutions for such portable electronic devices, which include MP3 and other music players, cell phones, personal digital assistants (PDAs), and the like. In use, a user commonly holds or wears the portable electronic device and such device comes with an ear phone which is positioned in the user's ear. The ear phone has a flexible lengthy cable that generally extends from the ear mounted ear phone to the portable electronic device to couple the signal from the portable electronic device to the earphone. When left unmanaged, the various headphone cables, power cables, and other cables used by such portable electronic devices and the like tend to become tangled and disorganized, especially when transported. Untangling such cables prior to use becomes time consuming and potentially leads to a situation in which such cables can become permanently tangled, caught on other objects, broken, or disengaged from the portable electronic device.

Moreover, electrically powered products such as appliances, tools, etc., are commonly equipped with an elongated power cord adapted for removable plug-in connection to an appropriate power source. In this regard, the power cord is typically provided with a sufficient length to accommodate anticipated normal use requirements, with the result that the cord has an unsightly excessive length which can become entangled in some applications. Moreover, when the electrical product is disconnected from a power source, difficulties are often encountered in wrapping the cord to a compact and neatly stored configuration ready for a subsequent use with minimum risk of cord entanglement. Alternately, although the cord might be neatly coiled for storage, unsatisfactory storage conditions often result in the cord becoming tangled prior to re-use of the electrical product or excessive wear to the cord causing premature cracking or failure. Similar problems arise with respect to electrical extension cords used to extend the length of a power cord for an electrical product.

A variety of devices have been proposed for use in retaining all or part of a cord in a neatly stored configuration. Such devices have included various tie strap structures designed to be tied about a coiled cord, particularly for maintaining a neat and attractive cord appearance when the electrical product is new. However, these tie straps have been intended to be discarded when the electrical product is first used. Another style of wrap devices is a reel or spool, designed for winding the cord thereabout, again for maintaining the cord in an untangled state especially for ease of use without having to untangle the cord prior to use. Moreover, tie straps and wrap devices are not designed for permanent attachment to an associated cord, such that the strap or wrap device is physically separated from the cord during normal use and thus easily becomes lost or resulting in the cord becoming tangled and disorganized.

Therefore, it is readily apparent that there is a recognizable unmet need for a cable management system and method of use for wrapping and tying a cable or the like, wherein the cable management system is integrated with the cable and, thereby, prevents the cable from becoming tangled and disorganized between uses, ready for a subsequent use with minimum risk of cord entanglement or separation of the cable management system from the cord.

BRIEF SUMMARY

Briefly described, in an example embodiment, the present apparatus overcomes the above-mentioned disadvantages and meets the recognized need for a cable management system and method of use integrated with the cable comprising, in general, a coiled cable, a bendable elongated member positioned on one section of the cable, an attachment means to affix the elongated member to the cable, wherein the bendable elongated member is integrated with the one section of the cable and is configured to wrap around the coiled cable and, thus, functions to maintain the coiled cable in an organized manner ready for a subsequent use with minimum risk of cord entanglement.

According to its major aspects and broadly stated, the present system meets the recognized need for a cable management system comprising, in general, a cable management system to retain a flexible cable, the system comprising: a bendable elongated member in parallel proximity with one section of the flexible cable are formed integrally; wherein said bendable elongated member and said one section of the flexible cable configured to wrap one or more times around a series of adjacent loops of the flexible cable.

In a further exemplary embodiment of a cable management system, the system includes a cable management system to retain a flexible cable in an untangled configuration ready for subsequent use with minimum risk of cable entanglement, the system comprising: a bendable elongated member positioned in parallel proximity to one section of the flexible cable; wherein said bendable elongated member affixed to said one section of the flexible cable; wherein said bendable elongated member is configured to wrap one or more times around a central region of a series of adjacent loops of the flexible cable.

In still a further exemplary embodiment, the method of method of retaining a flexible cable in a neat, organized, and untangled manner ready for subsequent use with minimum risk of cord entanglement includes the steps of utilizing a bendable elongated member, positioning said bendable elongated member in parallel proximity to one end of flexible cable, affixing said bendable elongated member to said one end of flexible cable to form a cable management system, coiling flexible cable in a series of adjacent elongated loops, and wrapping said cable management system around said series of adjacent elongated loops.

Accordingly, a feature of the cable management system is its ability to accommodate and maintain various sizes, shapes and dimensions of cable and or cord in an untangled state.

Another feature of the cable management system is its ability to integrate the cable management system with the cable or cord, whereby the cable or cord cannot be physically separated from the cable or cord or lost.

Still another feature of the cable management system is its ability to provide a substantially simple construction and simple use for neatly tying and storing an electrical power cord or the like or excess length portions of a power cord in use.

Yet another feature of the cable management system is its ability to hold the cable or cord in a compact storage configuration by wrapping a section of the cable or cord integrated with the cable management system snugly about a central region of the cable or cord coiled and shaped into a series of adjacent elongated loops.

Yet another feature of the cable management system is its ability to provide a cable or cord management system that reduces entanglement during repeated dispensing, storage and utilization.

Yet another feature of the cable management system is its ability to provide a cable or cord management system that is capable of organizing and storing cable, cord, string, rope, and other lengthy coiled or looped items in an organized manner.

Yet another feature of the cable management system is its ability to provide a cable or cord management system that allows a user to transport a cable or cord without entanglement.

Yet another feature of the cable management system is its ability to provide an attachment device having a tacky surface for retaining its state of being wound about the coiled or looped cable without slippage.

Yet another feature of the cable management system is its ability to eliminate any tangled cable or cord and to take up any slack to provide a neat appearance of the cable or cord.

Yet another feature of the cable management system is its ability to take up excess slack of the cable or cord that is not in use.

Yet another feature of the cable management system is its ability to provide an extension or jumper cable, which can function as a cable tie.

Yet another feature of the cable management system is its ability to retain the cable or cord snugly in a tensioned manner without any locking, clasping or latching member.

Yet another feature of the cable management system is its ability to retain the cable or cord snugly in a tensioned manner without utilizing a component which may be separated or lost.

Yet another feature of the cable management system is its ability to be adapted for directly affixing to the cable or cord so that the cable management system will not become displaced or lost when the cable management system is not in use.

Yet another feature of the cable management system is its ability incorporate a loop to enable placement of the loop over a hook or nail to store the cable or cord.

These and other features of the trim assembly will become more apparent to one skilled in the art from the following Brief Description of the Drawings, Detailed Drawings, Detailed Description and Claims when read in light of the accompanying drawings.

BRIEF DESCRIPTION OF THE DRAWINGS

The present cable management system and method of use for wrapping and tying a coiled cable or the like will be better understood by reading the Detailed Description of the embodiments with reference to the accompanying drawings, in which like reference to numerals denote similar structures and refer to like elements throughout, and in which:

FIG. 1.1, 1.2, 1.3 is a side view of an example embodiment of the cable management system integrated with the cable and shown disorganized and tangled (1.1), neatly looped (1.2), and stored with cable management system wrapped snugly about a central region of a series of adjacent elongated loops of the earphone cable (1.3);

FIG. 2 is a partial cross sectional side view of a section S of an example embodiment of the cable management system integrated with a cable;

FIG. 3.1, 3.2 is a partial cross sectional side view of an example embodiment of cable management system integrated with an extension cable;

FIG. 4.1, 4.2 is a view of an example embodiment of affixing a bendable elongated member to a cable utilizing a rubber coating;

FIG. 5.1, 5.2 is a view of an example embodiment of affixing a bendable elongated member to a cable utilizing a strip of adhesive tape or peel and stick;

FIG. 6.1, 6.2 is a view of an example embodiment of affixing a bendable elongated member to a cable utilizing a heat shrink material;

FIG. 7.1, 7.2, 7.3 is a view of an example embodiment of a bendable elongated member formed with crimpable segments, clips, or is wrapped to affix to a cable;

Figure 8:
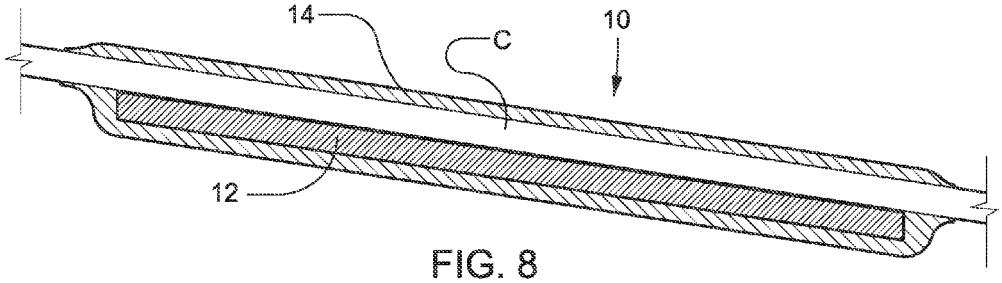
FIG. 8 is a view of an example embodiment of a group of wires and a bendable elongated member bound together to form a cable.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1.1, 1.2, 1.3, 2, 3.1, 3.2, 4.1, 4.2, 5.1, 5.2, 6.1, 6.2, 7.1, 7.2, 7.3, 8, 9 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIG. 1.1, 1.2, 1.3 by way of example, and not limitation, there is illustrated an example cable C for communicating a signal from an electronic device or media device such as portable electronic device, which includes MP3 and other music players, cell phones, personal digital assistants (PDAs), tablets, notebooks, laptops, computers, and the like. Cord or cable C includes one or more insulated conductors or sheathed wires insulated by an outer layer, such as polyethylene and typically bonded, twisted or braided together within an outer protective sheath bound together to carry or communicate one or more signals, power or the like to and from such electronic device. An exemplary flexible cable or cord such as cable C, shown in FIG. 1.1, includes headphones H, which further include earphone(s) E, which are typically positioned in the portable electronic device user's ear. The earphone(s) E has a flexible lengthy cable C that generally extends from the ear mounted ear phone E to an electrical adapter such a plug P configured to couple or communicate the signal from the portable electronic device through plug P, cable C, and earphone(s) E. Referring again to FIG. 1.1, which illustrates exemplary headphones H in a typical tangled and disorganized mess, especially when transported or stuffed into a user's pocket. Unfortunately, prior to each use exemplary headphones H must be untangled and organized to enable placement of ear phone E into the user's ear and freeing of flexible lengthy cable C to enable secure placement of plug P into its adapter port of electronic device. This ritual of untangling exemplary headphones H is time consuming and potentially leads to a situation in which cable C can become, permanently tangled, caught on other objects, broken, or disengaged from the electronic device.

Referring now to FIG. 1.2 there is illustrated exemplary headphones H with cable C shown neatly organized and coiled in a series of adjacent elongated loops and cable management system 10 integrated within one section S of cable C. Referring now to FIG. 1.3 there is illustrated exemplary headphones H with cable C shown neatly organized and coiled in a series of adjacent elongated loops with cable management system 10 wrapped or coiled around adjacent elongated loops of cable C and preferably configured to maintain cable C in a neat, organized, and untangled manner ready for subsequent use with minimum risk of cord entanglement. Preferably, subsequent use of headphones H may be achieved by tugging or pulling on plug P or the end of cable C to unwrap or uncoil cable management system 10, and thus, to free untangled flexible lengthy cable C, and more specifically to preferably enable electrical communication between earphone(s) E and the electronic device.

Referring now to FIG. 2 there is illustrated a cable with cable management system 10 affixed to cable C. Preferably, cable management system 10 includes a bendable elongated member such as wire 12 configured to wrap or coil one or more times around adjacent elongated loops of cable C and, thus, functions to releasably retain the coiled cable C, as shown in FIG. 1.3, and to maintain cable C in a neat, organized, and untangled manner ready for repeated subsequent unwrapping, dispensing, utilization, looping again, and re-wrapping cable C, wherein risk of entanglement of cable C is minimized or substantially eliminated. Wire 12 is preferably affixed, integrated or bonded to cable C by an adhesive, attachment, coating, cover or bond material such as rubber coat 14 configured to affix wire 12 to cable C. Preferably, rubber coat 14 and wire 12 are configured as a bendable elongated member affixed to section S of cable C to form a cable management system unit. Cable management system 10 is preferably positioned on one section S of cable C, and integrated with cable C to form a unitary permanent cable management system 10. Preferably, cable management system 10 is capable of providing sufficient wrap or coil holding force and/or tacky or friction surface and, thus, functions to maintain the coiled cable in an organized manner ready for repeated dispensing, storage and utilization with minimum risk of cord or cable entanglement, as shown in FIG. 1.3. Moreover, the tension which is supplemented by the natural spring characteristic of the elongated loops of cable C, serves to frictionally retain cable C within cable management system 10. The thickness of rubber coat 14 is varied to provide a combination of flexibility for repeated use and strength or resiliency to retain cable C and wire 12 snugly in a tensioned manner about cable C It is contemplated herein that cable C may have a variety of sizes, shapes, and dimensions and includes, but is not limited to, cables, cords, hose, tube, string, rope, and other lengthy coiled or looped items. Moreover, cable C may serve a variety of functions such as, but not limited to, power or communication with electrically powered products such as appliances, tools, electronic devices or media device such as portable electronic device, which includes MP3 and other music players, cell phones, personal digital assistants (PDAs), tablets, notebooks, laptops, computers, large appliances, small appliances, tools and the like. Furthermore, cable C may preferably include a variety of connectors, fittings, plugs or adapters such as electrical connectors positioned at one or both end(s) or distal end(s) of cable C including, but not limited to, a variety of shapes and dimensions of plugs, pronged plugs, adapters, terminals, posts, headphones, connectors, couplers, plug or socket, blade, ring, spade, male or female ends and the like (collectively plug P).

Wire 12 is preferably formed of a suitable flexible, semi-flexible, pliable or bendable material, such as lead, tin, or the like, or metal alloys, or composite materials, shape memory metals or shape memory alloys, or other malleable material, or other material providing a releasable fixed shape or the property of retaining a fixed shape. Preferably, the material includes other suitable characteristics, such as flexibility, resiliency, elasticity, durability, torsion strength, water-resistance, light weight, heat-resistance, chemical inertness, oxidation resistance, ease of workability, or other beneficial characteristic understood by one skilled in the art.

Rubber coat 14 is preferably formed of a suitable material, such as silicone, plastic, rubber, polymer, thermoplastic, insulated plastic, vinyl, polyvinyl, resin, layered materials, compositions, laminations, foam, heat shrink or shrink wrap material, tape, peel and stick, or the like, capable of providing a coated structure or cover material over cable C, and cable C and solder 12 of cable management system 10. Preferably, the material includes other suitable characteristics, such as flexibility, resiliency, elasticity, durability, friction or tacky surface, insulation, water-resistance, light weight, heat-resistance, chemical inertness, oxidation resistance, ease of workability, or other beneficial characteristic understood by one skilled in the art.

It is further contemplated herein that cable management system 10 may be fabricated as an integral component of the original cable C, such as for headphones H with a cable management system 10 or by adding cable management system 10 as an after market product utilizing a conversion kit to integrate cable management system 10 with cable C, resulting in an after market headphones H with a cable management system 10.

It is still further contemplated herein that the length of cable management system 10 is configured to be any desired length provided it is of satisfactory length for the storage of cable C, such as being configured to wrap one or more times around adjacent elongated loops of cable C.

Referring now to FIG. 3.1, 3.2 there is illustrated an extension cord or cable EC with cable management system 10. Preferably, extension cable EC includes cable management system 10 positioned between the ends of extension cable EC or between the two plugs, plug P1 and plug P2, or positioned at one end or distal end of extension cable EC. In use, for example, plug P1 of extension cable EC may be connected to another cable or a power source and plug P2 of extension cable EC may be connected to plug P of the cord or cable to utilize extension cable EC as an extension or jumper cable. In addition, extension cable EC may preferably be configured with cable management system 10 to wrap one or more times around adjacent elongated loops of the cord or cable and, thus, functions to releasably retain the coiled cord or cable in a neat configuration and organized in a manner, as shown in FIG. 3.2, ready for repeated subsequent unwrapping, dispensing, utilization, looping again, and re-wrapping of the cord or cable, wherein risk of entanglement of the cord or cable is minimized or substantially eliminated.

It is contemplated herein that extension cable EC may have a variety of sizes, shapes, and dimensions and includes, but is not limited to, cables, cords, string, rope, and other lengthy coiled or looped items. Moreover, extension cable EC may serve a variety of functions such as, but not limited to, power or communicate with electrically powered products such as appliances, tools, electronic devices or media device such as portable electronic device, which includes MP3 and other music players, cell phones, personal digital assistants (PDAs), tablets, notebooks, laptops, computers, large appliances, small appliances, tools and the like. Furthermore, extension cable EC may preferably include a variety of electrical connectors positioned at one end or distal end of extension cable EC including, but not limited to, a variety of shapes and dimensions of plugs, pronged plugs, adapters, terminals, posts, crimp connectors, plug or socket, blade, ring, spade, and the like.

Preferably, subsequent use of the cord or cable for its intended purpose may be achieved by tugging or pulling on plug P2 or the end of extension cable EC to unwrap or uncoil cable management system 10, and thus, to free untangled flexible lengthy cord or cable for lengthy extension of the cord or cable.

It is further contemplated herein that plug P1 or P2 of extension cable EC and the plug of the cord or cable may be locked or latched in position when for example plug P2 of extension cable EC and the plug of the cord or cable are connected.

It is still further contemplated herein that FIG. 3.2 may represent a variety of sizes, shapes, and dimensions of cord or cable as cables, cords, hose, tube, string, rope, and other lengthy coiled or looped items whereby cable management system 10 is utilized to wrap one or more times around adjacent elongated loops of the cord or cable and, thus, functions to releasably retain the coiled cord or cable in a neat configuration and organized in a manner, as shown in FIG. 3.2, ready for repeated subsequent unwrapping, dispensing, utilization, looping again, and re-wrapping the cord or cable, wherein risk of entanglement of the cord or cable is minimized or substantially eliminated.

It is yet further contemplated herein that cable management system 10 may be configured with a hanger or strap such as loop configured to support cable management system 10 and coiled or looped cord or cable may be positioned on a hook, nail or the like for storage of the cord or cable (as shown in FIG. 7.3).

Referring now to FIG. 4.1, 4.2 there is illustrated an exemplary embodiment cable management system 10 affixed to cable C. Cable management system 10 may be manufactured or assembled in various manners, for example, wire 12 of cable management system 10 may be positioned longitudinally approximate cable C as shown in FIG. 4.1. Moreover, wire 12 and cable C preferably may be held in close proximity by an adhesive or the like such as glue G, which can be applied to the surface of either wire 12 or cable C to affix the two items. It is contemplated herein that glue G may be any adhesive, thermoplastic adhesive or bonding agent or the like, specifically fast-acting adhesive capable of permanently or temporarily affixing wire 12 and cable C. Next, the end or section S of cable C positioned with wire 12 may be coated with rubber coat 14 as shown in FIG. 4.2, which is preferably capable of providing a coated structure or cover material to cable C and wire 12 and affixing together cable C and wire 12 in a flexible and bendable manner to operate as cable management system 10. Preferably, cable management system 10 functions to releasably retain the coiled cable C in a neat configuration and organized in a manner ready for repeated subsequent unwrapping, dispensing, utilization, looping again, and re-wrapping cable C, wherein risk of entanglement of cable C is minimized or substantially eliminated.

Referring now to FIG. 5.1, 5.2 there is illustrated an exemplary embodiment of cable management system 10 affixed to cable C. Cable management system 10 may be manufactured or assembled in various manners, for example, wire 12 of cable management system 10 may be positioned longitudinally approximate tape/tube 16 as shown in FIG. 5.1. Moreover, wire 12 preferably may be held in close proximity to cable C by a film or adhesive film such as tape/tube 16 or alternatively sandwiched between two tapes/tubes 16, and affixed thereto cable C. Alternatively, wire 12 may be held in close proximity to cable C by an adhesive or glue, which can be applied to the surface of either wire 12 or tape/tube 16 to affix the two items together. Next, tape/tube 16 may be affixed, wrapped or twisted around the end or section S of cable C as shown in FIG. 5.2, which is preferably capable of providing a covering to section S cable C and wire 12 and affixing together cable C and wire 12 in a flexible and bendable manner to operate as cable management system 10. In use, cable management system 10 may be wrapped or coiled around adjacent elongated loops of cable C and preferably configured to maintain cable C in a neat, organized, and untangled manner ready for subsequent use with minimum risk of cord entanglement. Preferably, cable management system 10 functions to releasably retain the coiled cable C in a neat configuration and organized in a manner ready for repeated subsequent unwrapping, dispensing, utilization, looping again, and re-wrapping cable C, wherein risk of entanglement of cable C is minimized or substantially eliminated.

Referring now to FIG. 6.1, 6.2 there is illustrated an exemplary embodiment of cable management system 10 affixed to cable 10. Cable management system 10 may be manufactured or assembled in various manners, for example, wire 12 of cable management system 10 may be positioned longitudinally approximate cable C as shown in FIG. 6.1. Moreover, wire 12 preferably may be held in close proximity to a film or shrink wrap material such as heat shrink tubing or alternatively heat shrink film or adhesive heat shrink film, or peel and stick heat shrink film, such as heat shrink tape/tube 16, or sandwiched between two tapes/tubes 16. Next, heat shrink tape/tube 16 may be wrapped around the end or section S of cable C as shown in FIG. 6.1. Next, heat shrink tape/tube 16 may be shrunk utilizing a heat source, such as blow dryer. When heat from heat source is applied to heat shrink tape/tube 16 it shrinks tightly over cable C and wire 12, as shown in FIG. 6.2, which is preferably capable of providing a cover material to cable C and wire 12 and, thus, joins together cable C and wire 12 in a flexible and bendable manner to operate as cable management system 10. Preferably, cable management system 10 functions to releasably retain the coiled cable C in a neat configuration and organized in a manner ready for repeated subsequent unwrapping, dispensing, utilization, looping again, and re-wrapping cable C, wherein risk of entanglement of cable C is minimized or substantially eliminated. In use, cable management system 10 may be wrapped or coiled around adjacent elongated loops of cable C and preferably configured to maintain cable C in a neat, organized, and untangled manner ready for subsequent use with minimum risk of cord entanglement. Preferably, cable management system 10 functions to releasably retain the coiled cable C in a neat configuration and organized in a manner ready for repeated subsequent unwrapping, dispensing, utilization, looping again, and re-wrapping cable C, wherein risk of entanglement of cable C is minimized or substantially eliminated.

It is contemplated herein that heat shrink tape/tube 16 may be configured with an inside diameter greater than plug P in FIG. 1.2 or the plug P1 or P2 of extension cable EC in FIG. 3.1, to enable heat shrink tape/tube 16 to fit over such plug P. Moreover, heat shrink tape/tube 16 may be configured to shrink from an initial inside diameter greater than plug P to a subsequent inside diameter capable of affixing wire 12 to cable C.

It is further contemplated herein that heat shrink tape/tube 16 may be configured as an adhesive shrink wrap film, or peel and stick shrink wrap film, as shown in FIG. 6.1, with an inside diameter less than plug P. Moreover, the two overlapping ends of heat shrink tape/tube 16 may be affixed together and configured to shrink from an initial inside diameter less than plug P to a subsequent inside diameter capable of affixing wire 12 to cable C. It is further contemplated herein that heat shrink tape/tube 16 may be configured with a non-shrink transition material utilized to affix the two overlapping ends of heat shrink tape/tube 16.

Heat shrink tape/tube 16 are preferably formed of a suitable heat shrinkable material capable of tightly bundling cable C and wire 12, such as nylon, polyolefin, polymer plastic, plastic, rubber, polymer, thermoplastic, insulated plastic, tape, peel and stick, or the like, capable of providing a coated structure or covering to cable C, and cable C and wire 12 of cable management system 10. Preferably, the material includes other suitable characteristics, such as flexibility, resiliency, elasticity, durability, friction or tacky surface, protection from dirt and moisture, insulation, water-resistance, light weight, chemical inertness, oxidation resistance, ease of workability, or other beneficial characteristic understood by one skilled in the art.

Referring now to FIG. 7.1, 7.2, 7.3 there is illustrated an exemplary embodiment of cable management system 10 affixed to cable C. Cable management system 10 may be manufactured or assembled in various manners, for example, wire 12 of cable management system 10 may be positioned longitudinally approximate cable C as shown in FIG. 7.1 Moreover, wire 12 preferably may be configured of any soft malleable material capable of deforming (crimping) or configured with one or more crimp members such as crimp 20 to adjoin or hold in close proximity wire 12 to one section S of cable C. Alternatively in FIG. 7.1, wire 12 of cable management system 10 may include straps 20 configured to be wrapped around cable C to hold cable C and wire 12 in close proximity. In use, wire 12 may be wrapped or coiled around adjacent elongated loops of cable C and preferably configured to maintain cable C in a neat, organized, and untangled manner ready for subsequent use with minimum risk of cord entanglement. Preferably, cable management system 10 functions to releasably retain the coiled cable C in a neat configuration and organized in a manner ready for repeated subsequent unwrapping, dispensing, utilization, looping again, and re-wrapping cable C, wherein risk of entanglement of cable C is minimized or substantially eliminated. Alternatively in FIG. 7.3, cable management system 10 may be configured to be wrapped around one section S of cable C extending therefrom and wrapped around another section S of cable C to hold cable C and cable management system 10 in close proximity. In use, cable management system 10 may be wrapped or coiled around adjacent elongated loops of cable C and preferably configured to maintain cable C in a neat, organized, and untangled manner ready for subsequent use with minimum risk of cord entanglement. Preferably, cable management system 10 functions to releasably retain the coiled cable C in a neat configuration and organized in a manner ready for repeated subsequent unwrapping, dispensing, utilization, looping again, and re-wrapping cable C, wherein risk of entanglement of cable C is minimized or substantially eliminated. It is contemplated herein that wire 12 of FIG. 7 may be covered with tape/tube 16 or rubber coat 14.

It is contemplated herein in FIG. 7.3 that cable management system 10 may incorporate a hanger or strap such as loop 22 preferably configured to position loop 22 over a hook or nail, and thus, functions to support cable management system 10 and cable C when in storage.

It is further contemplated herein that cable management system 10 may be wrapped or coiled around adjacent coiled loops of cable C, as shown in FIG. 7.2, and preferably configured to maintain cable C in a neat, organized, and untangled manner ready for subsequent use with minimum risk of cord entanglement.

Referring now to FIG. 8 there is illustrated an exemplary embodiment of cable management system 10 affixed to cable C. Shown in FIG. 8 preferably is an assembled cable management system 10 affixed to one end or section of cable C and shown in an uncoiled state ready for use. It is contemplated herein that cable management system 10 may be fabricated as an integral component of the original cable C, such as for headphones H with a cable management system 10 or by adding cable management system 10 as an after market product utilizing a conversion kit to integrate cable management system 10 with cable C, resulting in an after market headphones H or the like with a cable management system 10 integrally connected thereto.

It is contemplated herein that cable management system 10 may be positioned on cable C to enable cable C to be wrapped around products such as appliances, tools, electronic devices or media device such as portable electronic device, which includes MP3 and other music players, cell phones, personal digital assistants (PDAs), tablets, notebooks, laptops, computers, appliances, tools and the like, whereby cable management system 10 is positioned at one section, one end or distal end of cable C and configured to be the last or approximate to the last wrap around such products; and, thus, functions to releasably retain the wrapped cable C in a neat configuration and organized in a manner about such appliance, ready for repeated subsequent unwrapping, dispensing, utilization, wrapping again, and re-wrapping of cable C, wherein risk of entanglement of cable C is minimized or substantially eliminated.

Figure 9:
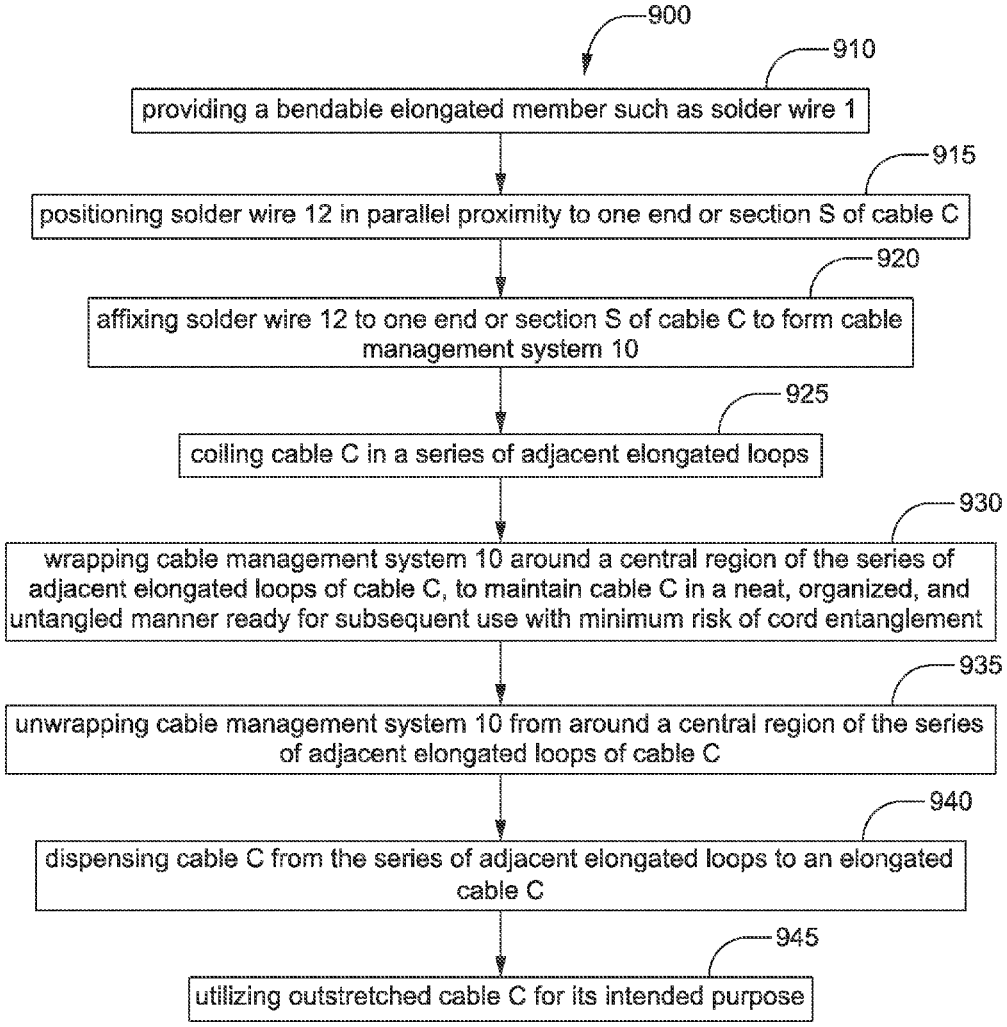
FIG. 9 is a flow diagram of a method of securing a bendable elongated member to a cable.

Referring now to FIG. 9, there is illustrated a flow diagram 900 of a method of retaining a cord or cable in a neat, organized, and untangled manner ready for subsequent use with minimum risk of cord entanglement. In block or step 910, providing a bendable elongated member such as wire 12 as described above in FIGS. 1-8. In block or step 915, positioning wire 12 in parallel proximity to one section, one end or distal end of cable C. In block or step 920, affixing wire 12 to one section, one end or distal end of cable C to form cable management system 10. In block or step 925, coiling cable C in a series of adjacent elongated loops or series of adjacent loops. In block or step 930, wrapping cable management system 10 around a central region of the series of adjacent elongated loops of cable C or around adjacent loops of cable C, to maintain cable C in a neat, organized, and untangled manner ready for subsequent use with minimum risk of cord entanglement. In block or step 935, unwrapping cable management system 10 from around a central region of the series of adjacent elongated loops of cable C. In block or step 940, dispensing cable C from the series of adjacent elongated loops to an elongated cable C. In block or step 945, utilizing outstretched cable C for its intended purpose.

The foregoing description and drawings comprise illustrative embodiments of the present invention. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention having been described in detail, it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. A cable management system to retain a flexible cable, the system comprising:

a pliable bendable elongated member in parallel proximity with one section of the flexible cable are formed integrally; wherein said bendable elongated member is integrated with one section of the flexible cable with a cover material selected from the group consisting of silicone, plastic, rubber, polymer, thermoplastic, insulated plastic, vinyl, polyvinyl, resin, layered materials, compositions, laminations, foam, heat shrink, film, tape, tape with peel and stick, and combinations thereof, wherein said pliable bendable elongated member and said one section of the flexible cable configured to wrap one or more times around a series of adjacent loops of the flexible cable.

2. The cable management system of claim 1, wherein said bendable elongated member configured to wrap around a central region of said series of adjacent loops of the flexible cable.

3. The cable management system of claim 2, wherein said series of adjacent loops of the flexible cable configured to be bunched together at said central region of said series of adjacent loops of the flexible cable.

4. The cable management system of claim 1, wherein said bendable elongated member configured to releasably retain the flexible cable in an untangled manner.

5. The cable management system of claim 1, wherein said bendable elongated member configured to accommodate various sizes of flexible cable.

6. The cable management system of claim 1, wherein said bendable elongated member configured to accommodate various types of cable selected from the group consisting of cord, string, rope, and other lengthy coiled items.

7. The cable management system of claim 1, wherein said bendable elongated member configured to enable transport of the flexible cable without entanglement.

8. The cable management system of claim 1, wherein said bendable elongated member is manufactured from a material selected from the group consisting of lead, tin, alloys, composite materials, shape memory metals, shape memory alloys, and combinations thereof.

9. The cable management system of claim 8, wherein said material offers characteristics selected from the group consisting of malleability, flexibility, resiliency, elasticity, durability, torsion strength, water-resistance, light weight, heat-resistance, chemical inertness, oxidation resistance, ease of workability, and combinations thereof.

10. The cable management system of claim 1, wherein said cover material offers characteristics selected from the group consisting of flexibility, resiliency, elasticity, durability, friction, tacky surface, insulation, water-resistance, light weight, heat-resistance, chemical inertness, oxidation resistance, ease of workability, and combinations thereof.

11. The cable management system of claim 1, wherein said cover material offers the characteristic of a tacky surface to retain said bendable elongated member in its state of being wrapped said one or more times around said series of adjacent loops of the flexible cable without slippage.

12. The cable management system of claim 1, wherein said bendable elongated member integrated with the flexible cable configured to take up the slack of the flexible cable not in use.

13. The cable management system of claim 1, wherein said bendable elongated member integrated with the flexible cable configured as an extension cable.

14. The cable management system of claim 13, wherein said extension cable configured to releasably retain the flexible cable in an untangled manner.

15. The cable management system of claim 1, wherein said flexible cable further comprises at least one plug positioned at a distal end of said flexible cable.

16. The cable management system of claim 1, wherein said bendable elongated member further comprises a loop configured to support the flexible cable.

17. A cable management system to retain a flexible cable in an untangled configuration ready for subsequent use with minimum risk of cable entanglement, the system comprising:

a pliable bendable elongated member positioned in parallel proximity to one section of the flexible cable; wherein said bendable elongated member is affixed to one section of the flexible cable with a cover material selected from the group consisting of silicone, plastic, rubber, polymer, thermoplastic, insulated plastic, vinyl, polyvinyl, resin, layered materials, compositions, laminations, foam, heat shrink, film, tape, tape with peel and stick, and combinations thereof, wherein said bendable elongated member affixed to said one section of the flexible cable;

wherein said pliable bendable elongated member is configured to wrap one or more times around a central region of a series of adjacent loops of the flexible cable.

18. The cable management system of claim 17, wherein said series of adjacent loops of the flexible cable configured to be bunched together at said central region of said series of adjacent loops of the flexible cable.

19. The cable management system of claim 17, wherein said bendable elongated member configured to releasably retain the flexible cable in an untangled manner.

20. The cable management system of claim 17, wherein said bendable elongated member configured to accommodate various sizes of flexible cable.

21. The cable management system of claim 17, wherein said bendable elongated member configured to accommodate various types of cable selected from the group consisting of cord, string, rope, and other lengthy coiled items.

22. The cable management system of claim 17, wherein said bendable elongated member is manufactured from a material selected from the group consisting of lead, tin, alloys, composite materials, shape memory metals, shape memory alloys, and combinations thereof.

23. The cable management system of claim 17, wherein said bendable elongated member affixed to the flexible cable configured as an extension cable.

24. The cable management system of claim 23, wherein said extension cable configured to releasably retain the flexible cable in an untangled manner.

25. The cable management system of claim 17, wherein said bendable elongated member formed of a malleable material capable of being crimped to the flexible cable.

26. The cable management system of claim 17, wherein said bendable elongated member configured with one or more straps to affix said bendable elongated member to the flexible cable.

27. A method of retaining a flexible cable in a neat, organized, and untangled manner ready for subsequent use with minimum risk of cord entanglement comprising the steps of:

utilizing a pliable bendable elongated member, wherein said bendable elongated member is affixed to one section of the flexible cable with a cover material selected from the group consisting of silicone, plastic, rubber, polymer, thermoplastic, insulated plastic, vinyl, polyvinyl, resin, layered materials, compositions, laminations, foam, heat shrink, film, tape, tape with peel and stick, and combinations thereof;

positioning said pliable bendable elongated member in parallel proximity to one end of flexible cable;

affixing said pliable bendable elongated member to said one end of flexible cable to form a cable management system;

coiling flexible cable in a series of adjacent loops; and wrapping said cable management system around said series of adjacent loops.

* * * * *